United States Patent [19]

Yuill

[11] Patent Number: 4,744,109

[45] Date of Patent: May 17, 1988

[54] GAS-SEALING INSERT FOR FLOOR DRAINS

[76] Inventor: Grenville K. Yuill, 1441 Pembina Highway, Winnipeg, Manitoba, Canada, R3T 2C4

[21] Appl. No.: 875,496

[22] Filed: Jun. 18, 1986

[30] Foreign Application Priority Data

Apr. 16, 1986 [CA] Canada ..... 506813

[51] Int. Cl.[4] ..... A47K 1/14

[52] U.S. Cl. ..... 4/287; 4/288; 4/293; 137/192; 137/433

[58] Field of Search ..... 4/286–295; 137/192–193

[56] References Cited

U.S. PATENT DOCUMENTS

| | | | |
|---|---|---|---|
| 178,137 | 5/1876 | Garland | 137/433 |
| 592,690 | 10/1897 | Bragger | 137/433 X |
| 2,199,673 | 5/1940 | Ronning | 137/433 X |
| 2,972,412 | 2/1961 | Lundeen | 137/192 X |
| 3,590,850 | 7/1971 | Grise | 137/192 |
| 3,838,706 | 10/1974 | Klenk et al. | 137/247.19 |
| 3,962,731 | 6/1976 | Cheiten | 4/393 |
| 4,535,800 | 8/1985 | Leech | 137/433 |
| 4,606,365 | 8/1986 | Siposs | 137/192 |
| 4,627,460 | 12/1986 | Eising | 137/192 |

FOREIGN PATENT DOCUMENTS

| | | |
|---|---|---|
| 2609345 | 8/1977 | Fed. Rep. of Germany . |
| 2134940A | 8/1984 | United Kingdom . |

*Primary Examiner*—Henry K. Artis

[57] ABSTRACT

A gas-sealing insert for floor drains. The insert comprises a cover for sealing a floor drain opening except for a hole passing through the cover, and tubing suspended below the cover for receiving water passing through the hole. The tubing, at one end, sealingly encircles the opening, and has an outlet at its other end. A water trap, e.g. a U-bend, is provided in the tubing between its two ends and a gas-sealing valve is located at the outlet. The valve can be opened by the presence of water passing through the tubing but closes automatically, preferably under the effect of gravity. The insert can be used to replace a conventional drain cover and seals the drain against seepage of noxious gases, such as radon, from the drain system even if the water in the U-bend evaporates when the drain is not used for prolonged periods.

7 Claims, 2 Drawing Sheets

GAS-SEALING INSERT FOR FLOOR DRAINS

BACKGROUND OF THE INVENTION

I. Field of the Invention

This invention relates to a gas-sealing insert for floor drains, and particularly for floor drains located in the basements of buildings.

II. Description of the Prior Art

It has recently become known that many houses and other buildings are built on soil and/or rock that slowly exudes radon gas, which is a radioactive gas which can cause cancer and other health problems. Over a period of time, the radon can accumulate in the building until harmful levels are reached. The currently popular trend of sealing buildings to make them more air-tight in order to reduce energy losses increases the danger of excessive radon build-up.

Many houses and other buildings have a concrete slab forming the basement floor and this acts as a barrier to the seepage of radon gas. However, it is usual to provide a drain in the basement floor and the floor drain may permit the entry of radon gas into the basement, particularly when the water in the U-trap usually provided in such drains dries out. This is a common occurrence because such floor drains are rarely used for the removal of water from the basement, so the water in the U-trap is rarely replenished.

SUMMARY OF THE INVENTION

There is accordingly a need to provide a means for permanently sealing such floor drains against gas infiltration. However, the sealing means should preferably not interfere with the normal function of the drain, i.e. its ability to act as an outlet for water.

According to the invention, there is provided a drop-in insert for a floor drain having an opening and a pipe extending substantially vertically downwardly from said opening at least for a predetermined distance, said insert comprising: a cover for seating at said drain opening and for sealing said opening except for at least one hole extending through the cover; tubing suspended below said cover and dimensioned to project into said pipe by a distance no greater than said predetermined distance, said tubing at one end thereof sealingly encircling said at least one hole in the cover and having an outlet at an opposite end and a water trap located between said one and said opposite ends; and an automatically closing gas-sealing valve located at said outlet, which valve is openable by the pressure of water when passing through said tubing.

By making the tubing, water trap and valve suitably small, the insert can be used in an existing floor drain, even if such drain is already provided with a U-trap. In a preferred form of the invention, the insert is provided with an extension in the form of an annular rubber membrane to seal any gap between the rim of the insert and the inner surface of the floor drain hole. This membrane can be flexible enough that the existing perforated floor drain cover plate can be replaced in its seat, pinching and holding the membrane in place. The gas-sealing valve does not interfere with ability of the drain to remove water, but it automatically moves to a sealing position when water stops flowing through the drain and thus acts as a permanent seal against radon gas infiltration through the drain. Even if the drain is not used for a period of years, the gas seal will remain effective even if the water in the water trap dries out.

The apparatus of the invention, at least in its preferred forms, has the advantage that it can be used in existing floor drains of conventional design and can thus be used to protect existing buildings without the need for structural alterations, or can be used in new buildings for use with conventional types of drains. The insert can be used simply by removing any existing drain cover and dropping the insert into the mouth of the drain.

Since the insert is of simple design, it can be manufactured inexpensively and thus provides an effective and economical means for dealing with the problem of radon gas infiltration.

DETAILED DESCRIPTION OF PREFERRED EMBODIMENTS

Figure 1:
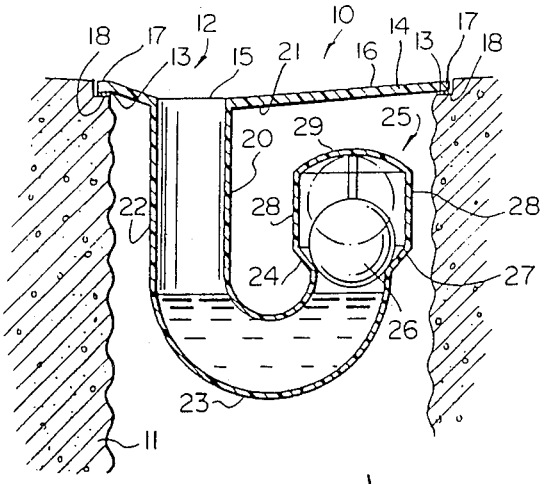
FIG. 1 is a cross-section of a floor drain showing an insert according to one embodiment of the present invention located therein.

Throughout the drawings and description of the various embodiments identical or similar parts are identified by the same reference numerals.

FIG. 1 shows a preferred drop-in insert 10 according to the invention located in a stand pipe 11 of a basement floor drain 12. Normally, such a drain would be covered by a circular perforated metal disc (not shown) acting as a cover and a grating, but the disc has been removed and has been replaced by the insert 10.

The insert consists of a circular metal or preferably plastic cover 14 having a circular hole 15 offset from the centre of the cover. The cover is slightly dished so that water on the upper surface 16 will flow to the hole 15 under the action of gravity. The outer periphery 17 of the cover fits snugly within the mouth of the drain 12 on the lip 18 normally provided for the conventional metal cover. A ring 13 of sealing material may be located between the periphery 17 and the lip 18 to provide a tight seal against the seepage of gases from the drain around the periphery of the cover 14.

Tubing 20 is attached to (or integral with) the lower surface 21 of the cover 14 in such a manner that the tubing is quite rigidly supported by the cover and water flowing through the hole 15 passes into the tubing. Further, the attachment of the tubing to the cover must be sealed so that gas outside the tubing 20 in the stand pipe 11 cannot pass through the junction of the tubing and the cover and thus pass through the hole 15.

The tubing 20 consists of a vertical run 22, a water trap 23 of U-shaped vertical cross-section and an outlet section 24 through which water from the tubing may enter the stand pipe 11 and be carried away.

A gas tight valve 25 is located at the outlet section 24 of the tubing. The valve comprises a ball 26 capable of floating on water and having an outer surface which is capable of forming an air-tight seal. For example, the ball may be made of rubber or soft plastic, or other slightly yieldable material. The ball seats onto an enlarged opening 27 at the end of the tubing 20 opposite to the cover 14. Three or more thin arms 28 project upwardly from the opening 27 to form a cage 29 surrounding the opening 27. The gaps between adjacent arms 28 are too small to permit the ball 26 to pass therethrough.

When water enters the hole 15 in the cover 14, it flows through the tubing 20 and discharges through the opening 27. This is permitted because the ball 26 is moved upwardly by the water flow to the position shown in broken lines, and the water is then free to flow out of the tubing between the arms 28. Once the flow of water has terminated, the ball 26 returns under gravity to the opening 27 and seals the tubing against the flow of gases from the stand pipe 11 to the hole 15. The cage 29 prevents the ball from being ejected into the stand pipe 11 and ensures that it returns properly to the opening 27 when the flow of water has ceased.

The water trap 23, when it has water in it as shown in FIG. 1, also acts as a seal against the flow of radon and other noxious gases from the stand pipe 11 to the hole 15. However, if this additional seal is lost due to evaporation of the water, the ball 26 still acts as a valve preventing the flow of gases.

By offsetting the hole 15 from the centre of the cover 14 as shown (see in particular FIG. 2), there is sufficient space available below the cover to accommodate the U-shaped tubing 20 and the cage 29. Moreover, the vertical height of the insert can be kept quite small, so that the insert may be located in conventional drains even if such drains themselves have a U-shaped bend close to the surface.

The cross-sectional area of the tubing 20 is considerably smaller than the cross-sectional area of the stand pipe 11, so the rate of flow of water through the drain may be less when the insert 10 is used than when a conventional perforated cover is employed. However, this is not disadvantageous in the case of floor drains for the basements of buildings, because such drains are rarely used and generally do not have to dispose quickly of large volumes of water. Moreover, if an increased water flow is required, the insert 10 can be temporarily removed.

The cover 14 and the tubing 20 and arms 28 may be made of metal or, more preferably, a plastic material such as ABS resin.

Figure 2:
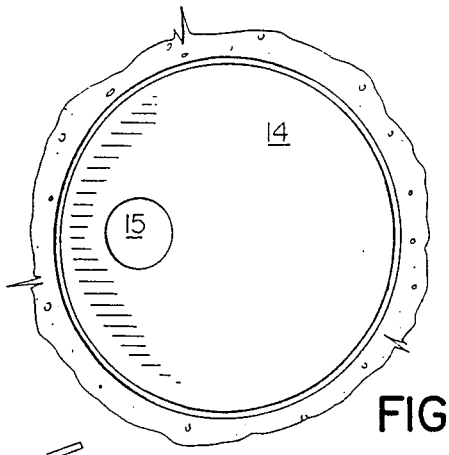
FIG. 2 is a plan view of the floor drain of FIG. 1.
Figure 3:
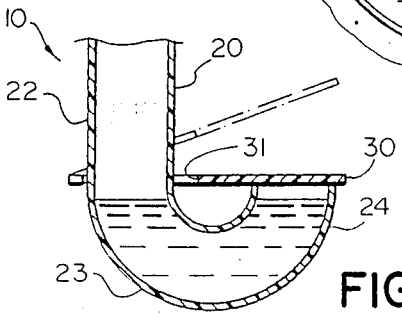
FIG. 3 is a cross-section of a part of an alternative insert according to the present invention.

FIG. 3 shows an alternative embodiment. The insert 10 is the same as that shown in FIGS. 1 and 2 except for the gas-tight valve. For this reason, only the valve and the adjacent tubing is shown.

In the embodiment of FIG. 3, the enlarged opening 27, the ball 26 and cage 29 of the previous embodiment have been replaced by a simple valve, which is preferably made of a synthetic resin or of rubber. The valve 30 has a hole 31 which is used to retain the valve on the vertical run 22 of the tubing 20. A part of the valve seats on the open end of the outlet section 24 of the tubing and seals the open end against the infiltration of gas. The valve 30 is preferably made of a synthetic resin or other yieldable material so that a good seal can be achieved.

When water flows through the tubing 20, the water pressure raises the valve, e.g. to the position shown in broken lines in the drawing. Once the flow of water is terminated, the valve returns to the sealing position under the effect of gravity. A light spring may be used to assist the return of the valve if this is believed to be advantageous in particular circumstances, or the entire valve may be made of elastic material such as rubber for the same reason.

When the valve 30 is not made of flexible material, the hole 31 should be made sufficiently larger than the tubing 20 to permit free movement of the valve. However, the valve 30 may be attached to the vertical run 22, e.g. by pins (not shown) extending at right angles to the plane of the page in FIG. 3, which permit tilting of the valve as shown, but prevent horizontal rotation which could have the effect of moving the valve 30 away from the outlet section 24.

A problem which has been encountered in providing gas-sealing inserts for the retrofit market, i.e. to be fitted into drains in existing buildings, is that drain sizes and, in some cases, even drain shapes vary widely. The manufacture of different inserts specifically designed for each possible type of drain is not usually economic. To overcome this problem, the embodiment shown in FIGS. 4 and 5 has been developed. In this embodiment, the insert 10 is designed to fit the smallest drain likely to be encountered, and has an annular impermeable flexible membrane 40 firmly adhered or otherwise attached to the periphery of its cover 14. The flexible membrane is so designed that, when the insert is located in a large stand pipe 11, the outer edge of the membrane can be located beyond the rim of the stand pipe and an original grating 42 can be placed over the top of the membrane to anchor it in position and to provide a protective cover over the insert. A bead 43 of gas impermeable caulk may be provided between the periphery of the membrane and floor 44 of the building to prevent gases escaping around the edge of the membrane from the drain below.

Provided the membrane 40 is made large enough to exceed the diameter of the largest drain, the insert shown in this embodiment can be used in any existing drain of any size or shape. Excess membrane beyond the grating 42 can be cut off. The inner periphery of the membrane should not, of course, block the circular hole 15 of the cover.

The membrane 40 should be strong enough to carry the weight of the insert 10 and any water trapped therein or passing therethrough, but must be thin and flexible enough to bend readily at the junction of the grating 42 and the floor 44, so that the grating may seat properly in the mouth of the drain. Plastic-coated canvas is a suitable material but other fabrics and polymer films may also be used. Thin rubber sheeting is a particularly preferred material.

The insert can be installed by removing the existing grating 42 from a drain, running a bead of caulk around the edge of the drain hole, dropping the insert into the hole with the membrane 40 placed over the bead of caulk, and then re-locating the cover 42 in place. Preferably, the bead of caulk is located on the lip 18 of the drain so that the membrane is squeezed into it when the grating 42 is replaced. Excess membrane may then be cut off flush with the floor 44.

Figure 4:
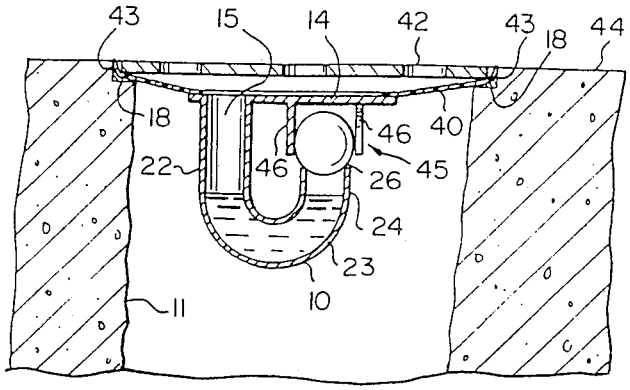
FIG. 4 is a cross-section similar to FIG. 1 showing an alternative embodiment.
Figure 5:
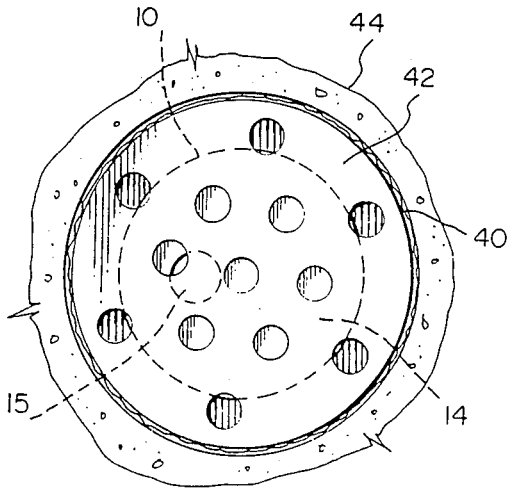
FIG. 5 is a plan view of the embodiment of FIG. 4.

The embodiment of FIGS. 4 and 5 also differs from the embodiment of FIGS. 1 and 2 in that the cage 29 at the end of tubing 24 of the former embodiment is omitted and, instead, a cage 45 for trapping the ball 26 is provided by three straight rods 46 extending downwardly from the lower surface of the cover 14. The rods have a triangular arrangement. The cage 45 is easier to manufacture than cage 29 of FIGS. 1 and 2 and, moreover, if the U-shaped section forming the water trap 23 is removable from the vertical run 22, the insert can easily be disassembled for cleaning if it becomes blocked since the ball 26 can be freed by lowering the outlet section 24 with respect to the cover 14.

It will be apparent to persons skilled in the art that various modifications and changes can be made to the preferred embodiments described above without affecting the nature of the invention. For example, the water trap 23 may be omitted if desired (i.e. the tubing 20 may be straight and a valve arrangement may be located at the bottom of the tubing), and the cover 14 may be made entirely of a flexible membrane instead of having a stiff and inflexible cover 14 and a flexible annular membrane 40 at its outer periphery. All such modifications and changes form part of the present invention to the extent that they fall within the scope of the following claims.

I claim:

1. A drop-in insert for a floor drain having an opening and a pipe extending substantially vertically downwardly from said opening at least for a predetermined distance, said insert comprising:

a cover for seating at said drain opening and for sealing said opening except for at least one hole extending through the cover;

tubing suspended below said cover and dimensioned to project into said pipe by a distance no greater than said predetermined distance, said tubing at one end thereof sealingly encircling said at least one hole in the cover and having an outlet at an opposite end and a water trap located between said one and said opposite ends; and an automatically closing gas-sealing valve located at said outlet, which valve is openable by the pressure of water when passing through said tubing;

wherein the cover has an enlarged, annular, gas-impermeable, flexible membrane attached thereto.

2. An insert according to claim 1 wherein said cover has an upper surface with an outer periphery and said membrane has an inner periphery, said inner periphery of said annular membrane being attached to said outer periphery of the cover in a gas-tight manner.

3. An insert according to claim 1 wherein said membrane is made of plastic coated canvas material.

4. An insert according to claim 1 wherein said membrane is made of rubber.

5. A drop-in insert for a floor drain having an opening and a pipe extending substantially vertically downwardly from said opening at least for a predetermined distance, said insert comprising:

a cover for seating at said drain opening and for sealing said opening except for at least one hole extending through the cover, said cover comprising an annular gas-impermeable, flexible membrane, at least at an outer periphery of the cover;

tubing suspended below said cover and dimensioned to project into said pipe by a distance no greater than said predetermined distance, said tubing at one end thereof sealingly encircling said at least one hole in the cover and having an outlet at an opposite end; and an automatically closing gas-sealing valve located at said outlet, which valve is openable by the pressure of water when passing through said tubing.

6. An insert according to claim 5 wherein the cover has a central area surrounding said at least one hole, said central area being stiff and inflexible.

7. An insert according to claim 5 wherein a water trap is located between said one and said opposite ends of the tubing, so that a portion of any water flowing through said tubing remains trapped therein to form a seal against the flow of gases.

* * * * *